US010973306B1

(12) United States Patent
Peters

(10) Patent No.: US 10,973,306 B1
(45) Date of Patent: Apr. 13, 2021

(54) FIREFIGHTER BACKPACK ASSEMBLY

(71) Applicant: Ernest Peters, Holy Cross, AK (US)

(72) Inventor: Ernest Peters, Holy Cross, AK (US)

( * ) Notice: Subject to any disclaimer, the term of this patent is extended or adjusted under 35 U.S.C. 154(b) by 0 days.

(21) Appl. No.: 16/813,172

(22) Filed: Mar. 9, 2020

(51) Int. Cl.
*A45F 3/00* (2006.01)
*A45F 3/04* (2006.01)
*A62C 99/00* (2010.01)

(52) U.S. Cl.
CPC ..... *A45F 3/04* (2013.01); *A62C 99/00* (2013.01); *A45F 2003/003* (2013.01); *A45F 2200/0575* (2013.01)

(58) Field of Classification Search
CPC ..... A45F 3/04; A45F 2003/003; A45F 2200/0575; A62C 99/00
USPC ..... 224/628
See application file for complete search history.

(56) References Cited

U.S. PATENT DOCUMENTS 1,714,819 A 5/1929 Rhodes
2,742,212 A * 4/1956 Siftar ..... A47D 13/025 224/161
2,841,317 A * 7/1958 Elden ..... A45F 3/10 224/628
2,967,649 A * 1/1961 Mack ..... A45F 3/10 224/263
3,127,077 A * 3/1964 Faro ..... A45F 3/08 224/629
3,207,395 A * 9/1965 Dunn ..... B27B 17/0008 224/633
3,549,064 A * 12/1970 Wilson ..... B25H 3/023 224/580
3,979,034 A 9/1976 Larman
4,248,367 A * 2/1981 Buel ..... A45F 4/02 224/153
4,558,808 A 12/1985 Fullmer
4,790,460 A 12/1988 Harper, Jr.
5,954,253 A * 9/1999 Swetish ..... A45F 3/08 224/628
6,607,108 B2 8/2003 Mydans
7,382,104 B2 6/2008 Jacobson
7,703,645 B2 * 4/2010 Moskun ..... A45F 3/08 224/581
10,219,608 B2 * 3/2019 Ball ..... A63C 17/0006

* cited by examiner

*Primary Examiner* — Peter N Helvey

(57) ABSTRACT

A firefighter backpack assembly for transporting equipment for wildfire fighting includes a panel that is wearable on a user's back and a pair of shoulder straps each being coupled to the panel for wearing over a respective one of the user's shoulders. A tool bag is coupled to the panel to carry tools thereby facilitating hands-free transportation of the tools when the user wears the panel. A pair of belts is each coupled to the panel to secure a chainsaw to the panel thereby facilitating hands-free transportation of the chainsaw. A storage pouch is suspended from the tool bag to contain a fire shelter.

8 Claims, 4 Drawing Sheets

FIREFIGHTER BACKPACK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to backpack devices and more particularly pertains to a new backpack device for transporting equipment for wildfire fighting.

(2) Description of Related Art Including Information Disclosed Under 37 CFR 1.97 and 1.98

The prior art relates to backpack devices. The prior art discloses a belt and cord device that can suspend a power tool from a user thereby facilitating the user to climb a tree. The prior art also discloses a variety of backpacks which have a rigid panel to facilitate a user to carry heavy objects with relatively little fatigue. In several instances, in combination with the rigid panel, a clamping mechanism is disclosed for fastening a chainsaw to the rigid panel. In several instances, in combination with the rigid panel, at least one pocket or sleeve is disclosed for insertably receiving a chain bar of a chainsaw.

BRIEF SUMMARY OF THE INVENTION

An embodiment of the disclosure meets the needs presented above by generally comprising a panel that is wearable on a user's back and a pair of shoulder straps each being coupled to the panel for wearing over a respective one of the user's shoulders. A tool bag is coupled to the panel to carry tools thereby facilitating hands-free transportation of the tools when the user wears the panel. A pair of belts is each coupled to the panel to secure a chainsaw to the panel thereby facilitating hands-free transportation of the chainsaw. A storage pouch is suspended from the tool bag to contain a fire shelter.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
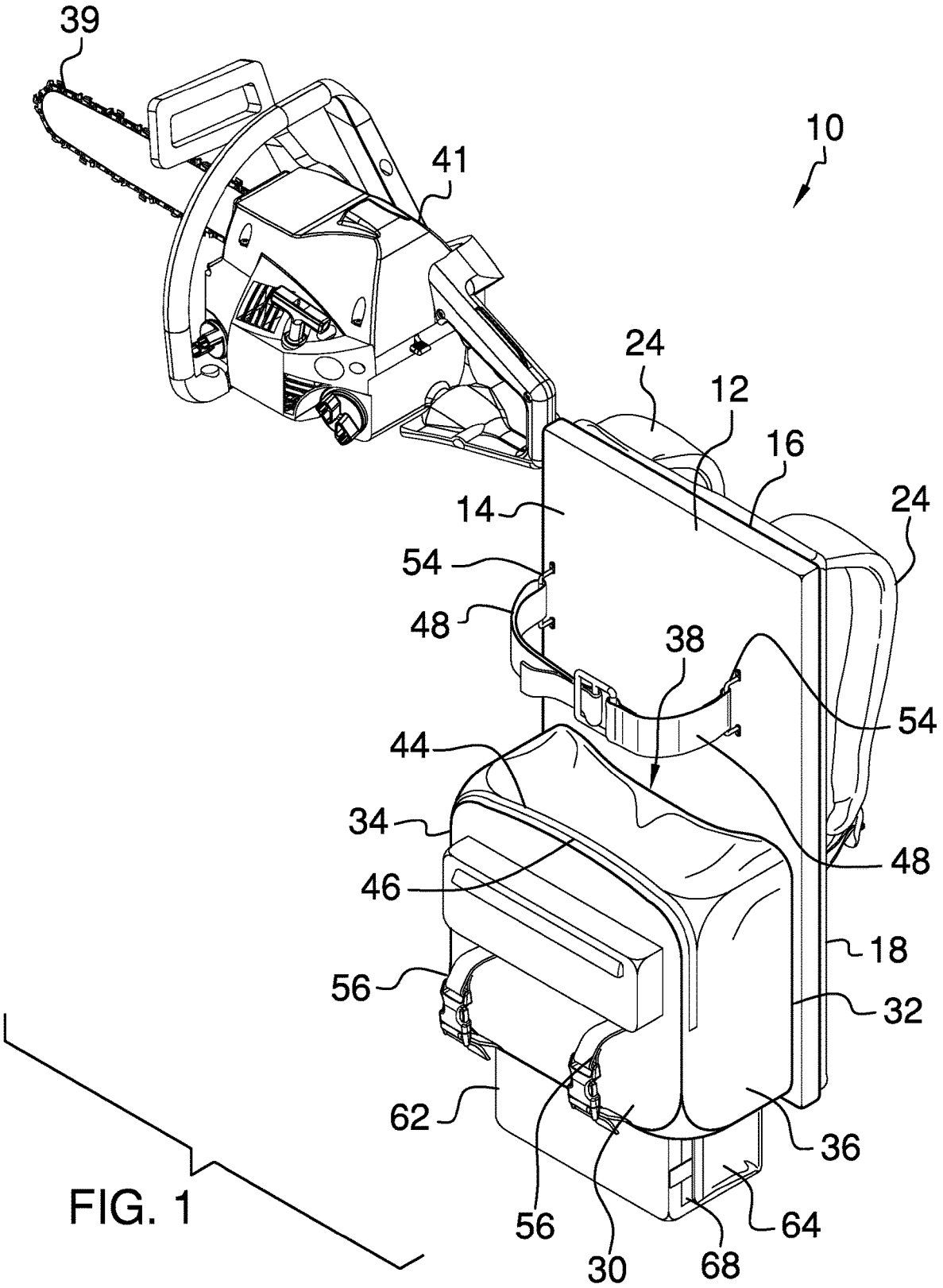
FIG. 1 is a perspective view of a firefighter backpack assembly according to an embodiment of the disclosure.
Figure 2:
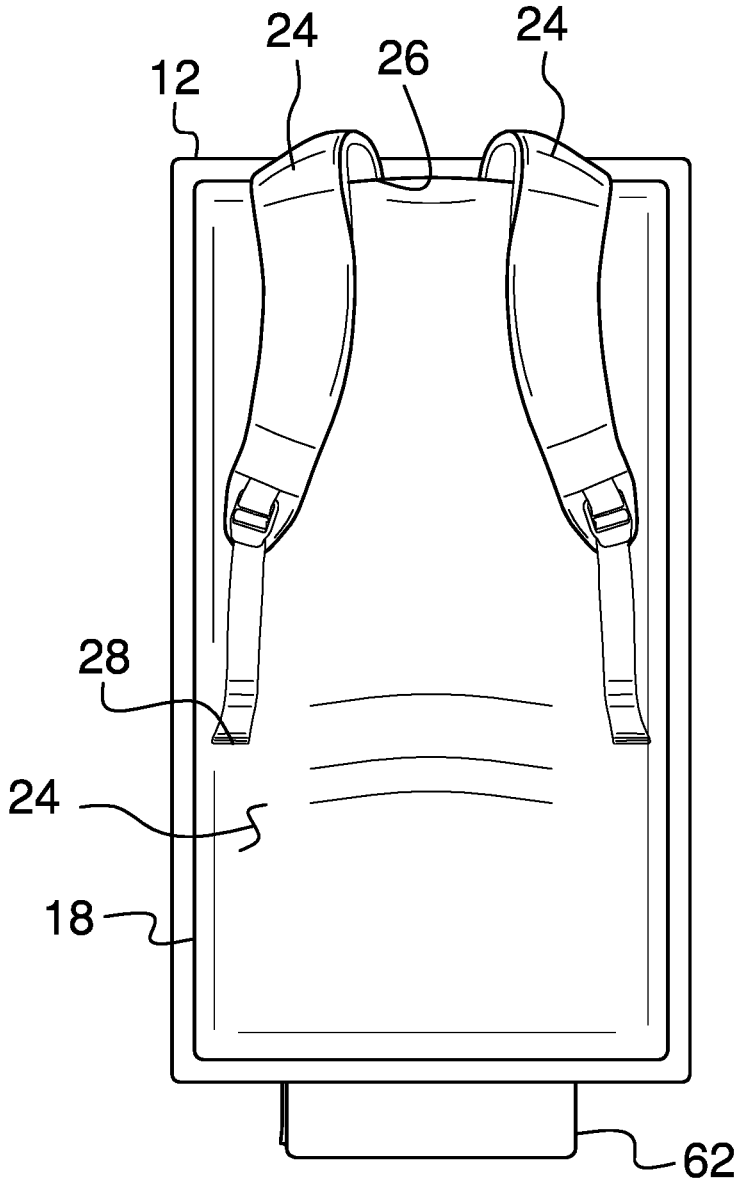
FIG. 2 is a front view of an embodiment of the disclosure.
Figure 3:
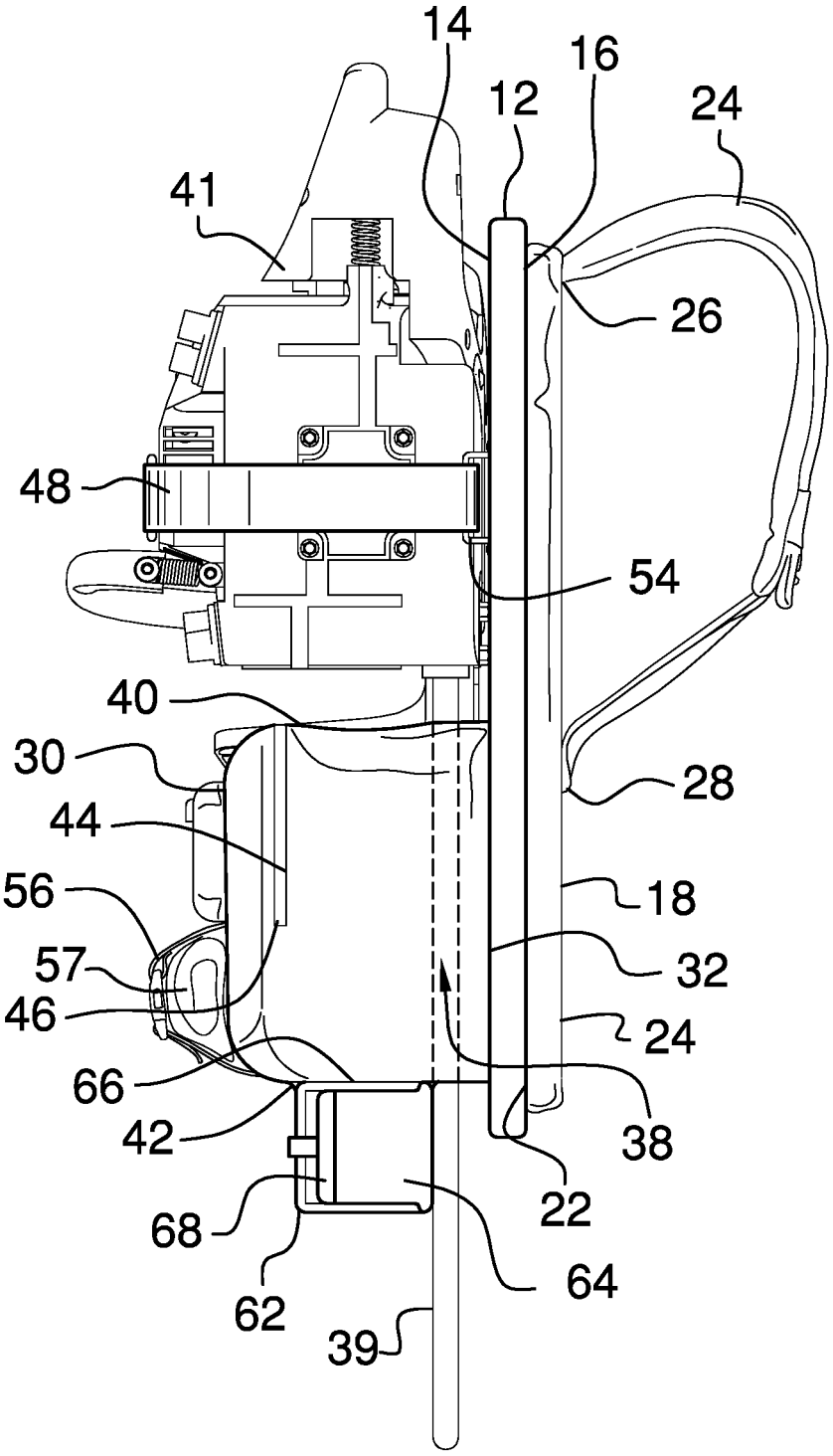
FIG. 3 is a right side view of an embodiment of the disclosure.
Figure 4:
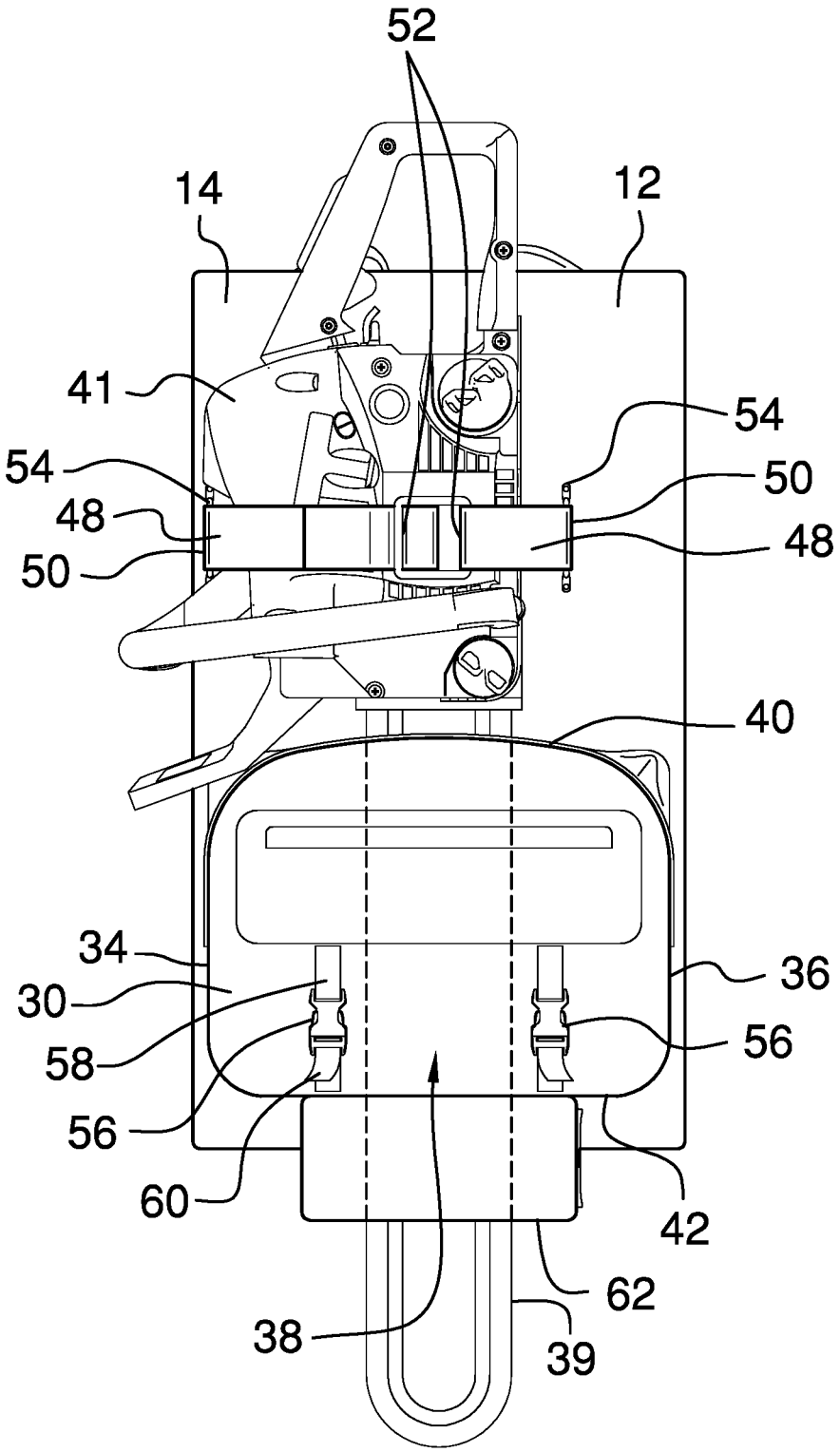
FIG. 4 is a back view of an embodiment of the disclosure.

With reference now to the drawings, and in particular to FIGS. 1 through 4 thereof, a new backpack device embodying the principles and concepts of an embodiment of the disclosure and generally designated by the reference numeral 10 will be described.

As best illustrated in FIGS. 1 through 4, the firefighter backpack assembly 10 generally comprises a panel 12 that is wearable on a user's back. The panel 12 has a front side 14 and a back side 16 that abuts the user's back when the panel 12 is worn. A pad 18 is provided and the pad 18 is coupled to the panel 12 to abut the user's back. Moreover, the pad 18 is comprised of a resiliently compressible material to enhance comfort for the user. The pad 18 has a front surface 20 and a back surface 22, and the back surface 22 is bonded to the back side 16 of the panel 12 having the pad 18 substantially covering the back side 16. The panel 12 may have a length ranging between approximately 18.0 inches and 24.0 inches.

A pair of shoulder straps 24 is provided and each of the shoulder straps 24 is coupled to the panel 12 for wearing over a respective one of the user's shoulders. Each of the shoulder straps 24 has a first end 26 and a second end 28, and each of the first end 26 and the second end 28 of each of the shoulder straps 24 is coupled to the front surface 20 of the pad 18. Additionally, each of the shoulder straps 24 is vertically oriented on the pad 18 and each of the shoulder straps 24 has an adjustable length.

A tool bag 30 is coupled to the panel 12 to carry tools thereby facilitating hands-free transportation of the tools when the user wears the panel 12. The tool bag 30 has a rear side 32, a first lateral side 34 and a second lateral side 36. The tool bag 30 is coupled to the front side 14 of the panel 12 along an intersection between the rear side 32 and the first lateral side 34. Additionally, the tool bag 30 is coupled to the front side 14 along an intersection between the rear side 32 and the second lateral side 36. The rear side 32 of the tool bag 30 is free from the front side 14 of the panel 12 to define a blade space 38 extending between an upper end 40 and a lower end 42 of the tool bag 30 to accommodate a chain bar 39 of a chainsaw 41.

The upper end 40 of the tool bag 30 has a cut 44 extending into an interior of the tool bag 30. A closure 46 is coupled to the upper end 40 of the tool bag 30 and the closure 46 is coextensive with the cut 44. The closure 46 is positionable between an open position and a closed position for opening and closing the cut 44. Moreover, the closure 46 may comprise a zipper, a hook and loop fastener, a plurality of snaps or any other type of releasable closure.

A pair of belts 48 is provided and each of the belts 48 is coupled to the panel 12. Each of the belts 48 is matable to each other to secure a chainsaw 41 to the panel 12 thereby facilitating hands-free transportation of the chainsaw 41. Each of the belts 48 has a primary end 50 and a secondary end 52, and the secondary end 52 of each of the belts 48 is matable together. Each of the belts 48 may include a mating member, such as a buckle or the like, and the mating members on the belts 48 releasably engage one another.

A pair of couplers 54 is provided and each of the couplers 54 is coupled to the front side 14 of the panel 12. Each of the couplers 54 is spaced apart from a vertical centerline of the panel 12. Moreover, each of the couplers 54 has the primary end 50 of a respective one of the belts 48 being coupled thereto and each of the couplers 54 is positioned above the tool bag 30. Each of the couplers 54 may comprise a bridge, a clasp, a ring or any other type of coupler that the belts 48 can engage.

A pair of straps 56 is provided and each of the straps 56 is coupled to the tool bag 30 to secure a pair of chainsaw chaps 57 to the tool bag 30 for carrying. Each of the straps 56 is positioned on a front wall of the tool bag 30 and each of the straps 56 comprises a first half 58 that is matable to a second half 60. Each of the first half 58 and the second half 60 may include a mating member, such as a buckle or the like, for releasably attaching the first half 58 to the second half 60.

A storage pouch 62 is suspended from the tool bag 30 to contain a fire shelter 64. The fire shelter 64 may be a portable fire shelter of any conventional design that is commonly employed by wildfire fighters. The storage pouch 62 has a top side 66 and a first lateral side 68, and the top side 66 is coupled to the lower end 42 of the tool bag 30. The storage pouch 62 is spaced from the panel 12 for accommodating the chain bar 39 on the chainsaw 41. Additionally, the first lateral side 68 of the storage pouch 62 is open into an interior of the storage pouch 62 to receive the fire shelter 64 for storage.

In use, the chain bar 39 of the chainsaw 41 is extended downwardly through the blade space 38 and the pair of belts 48 is extended across the chainsaw 41 to retain the chainsaw 41 on the panel 12. Any desired tools are positioned in the tool bag 30, the chainsaw chaps 57 are secured with the pair of straps 56 and the fire shelter 64 is stored in the storage pouch 62. Each of the shoulder straps 24 is worn over the user's shoulder for carrying the panel 12 in the convention of a backpack. In this way a wildfire fighter can carry all of the necessary equipment while keeping both hands free. Thus, the wildfire fighter can more easily ascend an incline, navigate rough terrain and transport the necessary equipment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A firefighter backpack assembly for carrying a chainsaw and other tools employed fighting wildfires, said assembly comprising:

a panel being wearable on a user's back;

a pad being coupled to said panel wherein said pad is configured to abut the user's back, said pad being comprised of a resiliently compressible material wherein said pad is configured to enhance comfort for the user;

a pair of shoulder straps, each of said shoulder straps being coupled to said panel wherein each of said shoulder straps is configured to be worn over a respective one of the user's shoulders;

a tool bag being coupled to said panel wherein said tool bag is configured to carry tools thereby facilitating hands-free transportation of the tools when the user wears said panel, said tool bag having a blade space extending along a full height of said tool bag wherein said blade space is configured to accommodate a chain bar of a chain saw;

a pair of belts, each of said belts being coupled to said panel, each of said belts being matable to each other wherein each of said belts is configured to secure a chainsaw to said panel thereby facilitating hands-free transportation of the chainsaw;

a pair of straps, each of said straps being coupled to said tool bag wherein each of said straps is configured to secure a pair of chainsaw chaps to said tool bag for carrying, each of said straps being positioned on a front wall of said tool bag, each of said straps comprising a first half being matable to a second half; and a storage pouch being suspended from said tool bag wherein said storage pouch is configured to contain a fire shelter.

2. The assembly according to claim 1, wherein:

said panel has a front side and a back side being configured to abut the user's back;

said pad has a front surface and a back surface, said back surface being bonded to said back side of said panel having said pad substantially covering said back side; and each of said shoulder straps has a first end and a second end, each of said first end and said second end of each of said shoulder straps being coupled to said front surface of said pad, each of said shoulder straps being vertically oriented on said pad.

3. The assembly according to claim 2, wherein said tool bag has a rear side, a first lateral side and a second lateral side, said tool bag being coupled to said front side of said panel along an intersection between said rear side and said first lateral side, said tool bag being coupled to said front side along an intersection between said rear side and said second lateral side.

4. The assembly according to claim 3, wherein said rear side of said tool bag is free from said front side of said panel to define said blade space extending between an upper end and a lower end of said tool bag.

5. The assembly according to claim 3, further comprising a closure being coupled to said upper end of said tool bag, said closure being coextensive with said cut, said closure being positionable between an open position and a closed position for opening and closing said cut.

6. The assembly according to claim 1, wherein:

each of said belts has a primary end and a secondary end, said secondary end of each of said belts being matable together; and said assembly includes a pair of couplers, each of said couplers being coupled to a front side of said panel, each of said couplers being spaced apart from a vertical centerline of said panel, each of said couplers having said primary end of a respective one of said belts being coupled thereto, each of said couplers being positioned above said tool bag.

7. The assembly according to claim 1, wherein said storage pouch has a top side and a first lateral side, said top side being coupled to a lower end of said tool bag, said storage pouch being spaced from said panel for accommodating the chain bar on the chainsaw, said first lateral side being open into an interior of said storage pouch wherein said first lateral side is configured to receive the fire shelter for storage.

8. A firefighter backpack assembly for carrying a chainsaw and other tools employed fighting wildfires, said assembly comprising:

a panel being wearable on a user's back, said panel having a front side and a back side being configured to abut the user's back;

a pad being coupled to said panel wherein said pad is configured to abut the user's back, said pad being comprised of a resiliently compressible material wherein said pad is configured to enhance comfort for the user, said pad having a front surface and a back surface, said back surface being bonded to said back side of said panel having said pad substantially covering said back side;

a pair of shoulder straps, each of said shoulder straps being coupled to said panel wherein each of said shoulder straps is configured to be worn over a respective one of the user's shoulders, each of said shoulder straps having a first end and a second end, each of said first end and said second end of each of said shoulder straps being coupled to said front surface of said pad, each of said shoulder straps being vertically oriented on said pad;

a tool bag being coupled to said panel wherein said tool bag is configured to carry tools thereby facilitating hands-free transportation of the tools when the user wears said panel, said tool bag having a rear side, a first lateral side and a second lateral side, said tool bag being coupled to said front side of said panel along an intersection between said rear side and said first lateral side, said tool bag being coupled to said front side along an intersection between said rear side and said second lateral side, said rear side of said tool bag being free from said front side of said panel to define a blade space extending between an upper end and a lower end of said tool bag wherein said blade space is configured to accommodate a chain bar of a chain saw, said upper end of said tool bag having a cut extending into an interior of said tool bag;

a closure being coupled to said upper end of said tool bag, said closure being coextensive with said cut, said closure being positionable between an open position and a closed position for opening and closing said cut;

a pair of belts, each of said belts being coupled to said panel, each of said belts being matable to each other wherein each of said belts is configured to secure a chainsaw to said panel thereby facilitating hands-free transportation of the chainsaw, each of said belts having a primary end and a secondary end, said secondary end of each of said belts being matable together;

a pair of couplers, each of said couplers being coupled to said front side of said panel, each of said couplers being spaced apart from a vertical centerline of said panel, each of said couplers having said primary end of a respective one of said belts being coupled thereto, each of said couplers being positioned above said tool bag;

a pair of straps, each of said straps being coupled to said tool bag wherein each of said straps is configured to secure a pair of chainsaw chaps to said tool bag for carrying, each of said straps being positioned on a front wall of said tool bag, each of said straps comprising a first half being matable to a second half; and a storage pouch being suspended from said tool bag wherein said storage pouch is configured to contain a fire shelter, said storage pouch having a top side and a first lateral side, said top side being coupled to said lower end of said tool bag, said storage pouch being spaced from said panel for accommodating the chain bar on the chainsaw, said first lateral side being open into an interior of said storage pouch wherein said first lateral side is configured to receive the fire shelter for storage.

* * * * *